United States Patent [19]

Naro et al.

[11] Patent Number: 5,008,074

[45] Date of Patent: Apr. 16, 1991

[54] INOCULANT FOR GRAY CAST IRON

[75] Inventors: Rodney L. Naro, Worthington, Ohio; James M. Csonka, Valencia, Pa.; Michael A. Merritt, New Haven, W. Va.

[73] Assignee: American Alloys, Inc., New Haven, W. Va.

[21] Appl. No.: 514,871

[22] Filed: Apr. 26, 1990

[51] Int. Cl.[5] ..... C22C 33/00

[52] U.S. Cl. ..... 420/578

[58] Field of Search ..... 420/578

[56] References Cited

U.S. PATENT DOCUMENTS

| | | | |
|---|---|---|---|
| 2,266,122 | 12/1941 | Kinzel | 420/578 |
| 4,086,086 | 4/1978 | Dawson | 420/578 |
| 4,377,411 | 3/1983 | Moore | 420/578 |
| 4,540,436 | 9/1985 | Wolfsgruber | 420/578 |
| 4,568,388 | 2/1986 | Dremann | 420/578 |

*Primary Examiner*—Peter D. Rosenberg

*Attorney, Agent, or Firm*—Webb, Burden, Ziesenheim & Webb

[57] ABSTRACT

An inoculating alloy for gray iron, said alloy consisting essentially of 65.0–70.0% silicon, 8.0–10% titanium, 5% max manganese, 2.0–2.5% barium, 1.0–1.5% calcium, 1.5% max aluminum, the balance being iron and incidental impurities.

5 Claims, No Drawings

INOCULANT FOR GRAY CAST IRON

1. BACKGROUND OF THE INVENTION

This invention relates to a composition of matter which is capable of graphitizing cast iron in a highly effective manner. More particularly, the invention relates to a titanium bearing ferrosilicon inoculant.

2. FIELD OF THE INVENTION

The usual microstructure of gray iron is a matrix of ferrite and pearlite with graphite flakes dispersed throughout. Foundry practice can be varied so that nucleation and growth of graphite flakes occurs in a pattern that enhances the desired properties. The amount, size and distribution of graphite are important to the physical properties of the gray iron. The use of inoculants to control microstructure as well as "chill" is common practice.

Numerous metals and alloys have been proposed for use as inoculating agents in the production of gray iron castings. Standard inoculating agents are silicon, calcium silicon, ferrosilicon or other silicon alloys as well as graphite.

In the manufacture of gray cast iron, certain casting practices makes use of nitrogen bearing hot box and cold box core binders. Use of these binders coupled with certain melting practices can cause harmful subsurface nitrogen gas porosity. In this connection it is known to use titanium which absorbs the nitrogen from the bonded sand molds and cases and combines with the nitrogen decomposition products to form nitrides at the face of the casting. Titanium, however, is known to cause the formation of generally undesirable Type D graphite flakes.

One such inoculant is known by the tradename of Graphidox. This inoculant is a titanium bearing 50% ferrosilicon alloy containing small amounts of calcium to promote Type A graphite flakes. Another such ferrosilicon inoculant containing strontium, calcium and either zirconium or titanium is disclosed in U.S. Pat. No. 4,666,516. Another titanium ferrosilicon alloy, this one containing magnesium is disclosed in U.S. Pat. No. 4,568,388. Finally, inoculating alloys for gray iron are also known which include barium, e.g., U.S. Pat. No. 3,137,570.

SUMMARY OF THE INVENTION

It is an object of this invention to provide an inoculating agent which causes the cementite in the iron to be substantially disassociated and the graphite to be evenly distributed in a beneficial manner throughout the section of the resultant casting.

It is another object of this invention to optimize the nucleaction sites on which flake graphite forms and grows and to provide a microstructure which is at least 70% Type A graphite and which has minimal Type D graphite flakes.

It is a further object of the invention to provide an inoculating agent which will control nitrogen porosity defects.

And it is still a further object of this invention to provide an inoculating agent which has an improved dissolution rate.

Our invention is an inoculating alloy for gray iron consisting essentially of 65–70% silicon, 8–10% titanium, 5% max manganese, 2–2.5% barium, 1.0–1.5% calcium, 1.5% aluminum max, the balance being iron and incidental impurities. The minimal manganese and aluminum contents are normally 0.5% and 0.1%, respectively. The resultant gray iron is characterized by a microstructure having at least 70% Type A graphite.

A preferred form of the inoculating alloy consists of essentially about 67.5% silicon, 1% aluminum, 1.25% calcium, 2.5% manganese, 2.25% barium, 9.0% titanium the balance being iron and incidental impurities.

DETAILED DESCRIPTION OF THE PREFERRED EMBODIMENTS

Our composition is an inoculating grade of a titanium bearing ferrosilicon alloy. The inoculant not only controls nitrogen porosity but gives an improved microstructure and chill reduction.

The silicon level was increased to 65–70% from the more conventional inoculants which are based on 50% ferrosilicon alloys so as to improve the dissolution rate of the inoculant.

Manganese in amounts up to 5% max is also employed to further enhance the dissolution rate.

The titanium in amounts of 8–10% is necessary to control the nitrogen porosity which often comes about through the use of high nitrogen containing no-bake binders, hot box, shell sand and cold box binders. It is also effective in controlling nitrogen subsurface porisity associated with the use of nitrogen bearing no-bake bonded reclaimed sands.

Aluminum in the amounts of 1.5% max is present as a deoxidizer and graphitizer.

Calcium which is added in amounts to result in 1–1.5% reacts with the sulfur and oxygen to form oxysulfides which acts as nucleation sites upon which flake graphite forms and grows.

Barium in the amount of 2–2.5% also forms nucleation sites through the formation of oxysulfides from the reaction of the barium with the sulfur and oxygen. We believe the barium controls the graphite precipitation which gives the improved flake structures and therefore less carbide formation or "chill" occurs in the castings. It appears that the calcium when used in conjunction with the barium gives improved results over the use of barium or calcium alone.

Table 1 below gives the heat weights and composition of an alloy made in accordance with our invention.

TABLE 1

| | *Heat Weights and Composition | | | | | | |
|---|---|---|---|---|---|---|---|
| | Pounds | Si | Al | Ca | Mn | Ba | Ti |
| **Molten AA-66 | 2820 | 63.35 | 1.56 | 1.78 | 10.08 | 4.31 | — |
| Molten Si Metal | 1780 | 98.49 | .45 | .10 | — | — | — |
| Titanium Plate | 500 | — | — | — | — | — | 99+ |
| Calcium Crown | 60 | — | — | 99+ | — | — | — |
| Alloy Produced *** | 5160 | 65.23 | .97 | 1.63 | 3.67 | 1.96 | 8.30 |

*This melt was made in a production electric arc furnace.
**A ferrosilicon alloy based on 75% silicon.
***The balance was iron and incidental impurities.

The testing of the gray iron product produced a uniform microstructure of gray iron having a matrix of pearlite with graphite flakes dispersed throughout. The microstructure included in excess of 70% Type A graphite and less than 10% Type D and E graphite combined.

The microstructures were obtained on the product of three separate molds using a computerized image analyzer. The Type A graphite flakes were 100%, 100% and 90% for an average of 97% Type A graphite flakes. These results compare favorably with similar tests conducted on the product of three separate molds in which the Graphidox inoculant referred to earlier was used. That product tested in the same manner exhibited Type A graphite flakes of 80%, 40% and 70% for an average of 63% Type A graphite flakes.

The inoculant was crystalline and silvery gray in appearance. It has a high solubility in cast iron with temperatures as low as 2450° F.

The results demonstrate that the inoculant not only controls nitrogen porosity defects but gives an improved microstructure and chill reduction over existing titanium ferrosilicon inoculants. Longer tool life and better mechanical and physical properties of the cast iron are achieved because of the improved microstructure.

I claim:

1. An inoculating alloy for gray iron, said alloy consisting essentially of 65.0–70.0% silicon, 8.0–10.0% titanium, 0 to 5% manganese, 2.0–2.5% barium, 1.0–1.5% calcium, 0 to 1.5% aluminum, the balance being iron and incidental impurities.

2. The alloy of claim 1, said manganese being present in an amount of 0.5–5%.

3. The alloy of claim 1, said aluminum being present in an amount of 0.1–1.5%.

4. The alloy of claim 1 consisting essentially of about 67% Silicon, 1.0% aluminum, 1.25% calcium, 2.5% manganese, 2.25% barium, 9.0% titanium, the balance being iron and incidental impurities.

5. The alloy of claims 1, 2, 3 or 4 characterized by a microstructure in the gray iron of at least 70% Type A graphite.

* * * * *

UNITED STATES PATENT AND TRADEMARK OFFICE

CERTIFICATE OF CORRECTION

PATENT NO. : 5,008,074

DATED : April 16, 1991

INVENTOR(S) : Rodney L. Naro, James M. Csonka and Michael A. Merritt

It is certified that error appears in the above-identified patent and that said Letters Patent is hereby corrected as shown below: On the title page;

Under References Cited U.S. PATENT DOCUMENTS insert

--3,137,570 6/1964 Mickelson 75/124
3,215,525 11/1965 Sprankle 75/123
3,250,609 5/1966 Bungardt et al. 75/84
3,272,623 9/1966 Crafts et al. 75/134
3,275,433 9/1966 Hilty et al. 75/134
3,661,566 5/1972 Percheron et al. 75/130
3,717,456 2/1973 Percheron et al. 75/130
3,762,914 10/1973 Voloschenko 75/130
3,765,875 10/1973 Septier et al. 75/130
3,905,809 9/1975 Malizio et al. 75/134
4,036,641 7/1977 Evans et al. 75/130
4,581,203 4/1986 Bruckmann 420/578
4,619,696 10/1986 Gorgerino 75/130
4,643,768 2/1987 Bruckmann et al. 420/578
4,666,516 5/1987 Hornung et al. 420/30
4,749,549 6/1988 Hornung et al. 420/578

OTHER PUBLICATIONS

ASM Review Committee on Cast Irons, "Gray Iron" pp. 11-13 and 28-29.
ASM Committee on Ductile Iron, "Ductile Iron" pp. 33, 36-38 and 40.--.

Signed and Sealed this

Twenty-second Day of September, 1992

*Attest:*

DOUGLAS B. COMER

*Attesting Officer* *Acting Commissioner of Patents and Trademarks*